United States Patent [19]

Alstrin et al.

[11] 4,111,166

[45] Sep. 5, 1978

[54] ENGINE MOUNTED EXHAUST BRAKE

[75] Inventors: Charles E. Alstrin, Peoria; Carl L. McClung, Metamora; James C. Smith, Washington, all of Ill.

[73] Assignee: Caterpillar Tractor Co., Peoria, Ill.

[21] Appl. No.: 766,314

[22] Filed: Feb. 7, 1977

[51] Int. Cl.[2] ..... F02D 9/06

[52] U.S. Cl. ..... 123/97 B; 188/273

[58] Field of Search ..... 123/97 R, 97 B, 107; 188/273; 251/305

[56] References Cited

U.S. PATENT DOCUMENTS

| | | | |
|---|---|---|---|
| 2,876,876 | 3/1959 | Cummins | 192/3 TR |
| 2,924,205 | 2/1960 | Williams | 123/97 B |
| 3,019,778 | 2/1962 | Kloss | 123/97 B |
| 3,234,923 | 2/1966 | Fleck et al. | 123/97 B |
| 3,523,418 | 8/1970 | Marsee | 123/97 B |
| 3,572,300 | 3/1971 | Stager et al. | 123/97 B |
| 3,770,242 | 11/1973 | O'Connor | 251/305 |
| 3,838,670 | 10/1974 | King | 123/97 B |

FOREIGN PATENT DOCUMENTS

| | | | |
|---|---|---|---|
| 2,309,363 | 2/1976 | France | 188/273 |

*Primary Examiner*—Charles J. Myhre
*Assistant Examiner*—Craig R. Feinberg
*Attorney, Agent, or Firm*—Phillips, Moore, Weissenberger, Lempio & Majestic

[57] ABSTRACT

A bolt-on exhaust brake for an internal combustion engine includes a damper movable to open and closed positions, and an air cylinder actuatable to move the damper to its closed position. The damper is openable upon back-pressure reaching 30 psi, so as to avoid damage to the engine.

4 Claims, 6 Drawing Figures

ENGINE MOUNTED EXHAUST BRAKE

BACKGROUND OF THE INVENTION

This invention relates to braking systems for vehicles, and more particularly to an exhaust braking system.

It is the general purpose of this invention to provide an engine braking exhaust system adaptable to an internal combustion engine including an exhaust line.

Exhaust braking systems of this type have as their object the retardation of moving vehicles by keeping the engine connected to the driving wheels in the usual manner through the transmission and operating the engine with a negative power output. The operation of braking is accomplished by permitting the throttle to assume its idle position and then blocking the exhaust pipe between the exhaust manifold and the muffler.

A system generally along these lines is disclosed in U.S. Pat. No. 2,924,205, which includes a damper placed in the exhaust line which may be appropriately positioned to block exhaust travel in the exhaust line. As stated in that patent, it is well known that the exhaust pressure in the line during the blocking operation may be built up to a value of 50 or 60 psi. It has been found that with such extremely high back pressure, a certain amount of valve train "float" and resulting valve train structural failure has occurred. It is the object of this invention to provide an engine exhaust brake which eliminates the amount of back pressure which can be built up in the exhaust systems to a level so as to avoid valve train "float" and possible resulting valve train structural failure.

Of more general interest in this area are U.S. Pat. No. 3,838,670, U.S. Pat. No. 3,234,923, and U.S. Pat No. 3,572,300, wherein no damper is utilized in the exhaust line. Also of general interest in this area is U.S. Pat. No. 2,876,876, disclosing a butterfly valve in the intake of the engine.

SUMMARY OF THE INVENTION

It is accordingly an object of this invention to provide an internal combustion engine exhaust brake which controls and limits the level of back pressure which can be built up in the exhaust system, so as to avoid the possibility of engine damage due to excessive back pressure buildup.

It is a further object of this invention to provide apparatus which, while fulfilling the above object, is extremely simple in design and effective in use.

Broadly stated, the invention comprises an exhaust brake apparatus for an internal combustion engine including an exhaust line, wherein exhaust back pressure is to be limited to a certain level. The apparatus comprises a damper movably mounted within the exhaust line, means operable by air pressure for moving the damper to its closed position, means biasing the damper toward the open position thereof, the damper being configured and positioned so that with a generally operable level of air pressure applied to the means operated by air pressure, the damper opens under a certain level of exhaust back pressure.

BRIEF DESCRIPTION OF THE DRAWINGS

These and other objects of the invention will become apparent from a study of the following specification and drawings, in which.

DESCRIPTION OF THE PREFERRED EMBODIMENT

Figure 1:
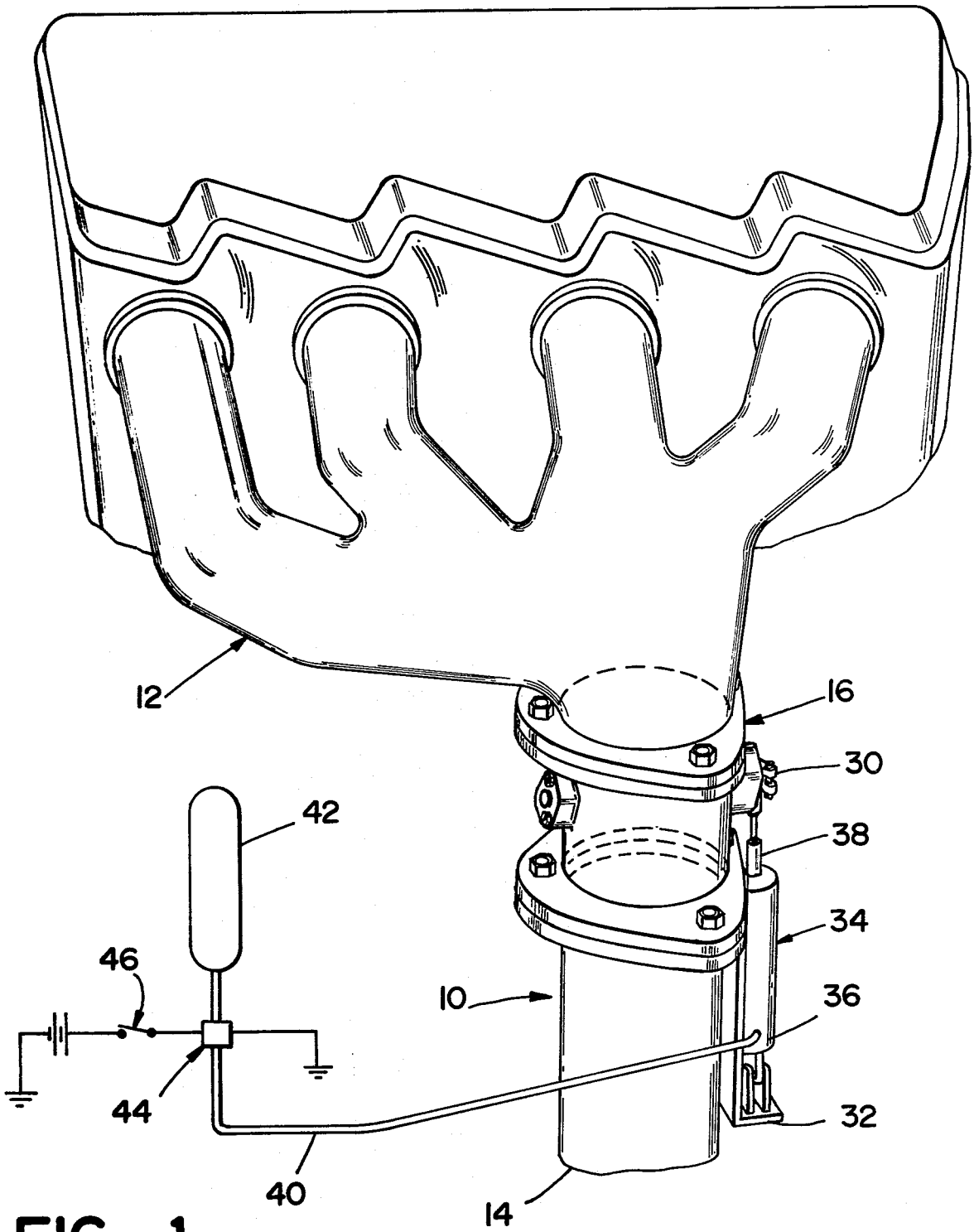
FIG. 1 is an overall view, partially in perspective an partially in schematic, of a system incorporating the invention.
Figure 3:
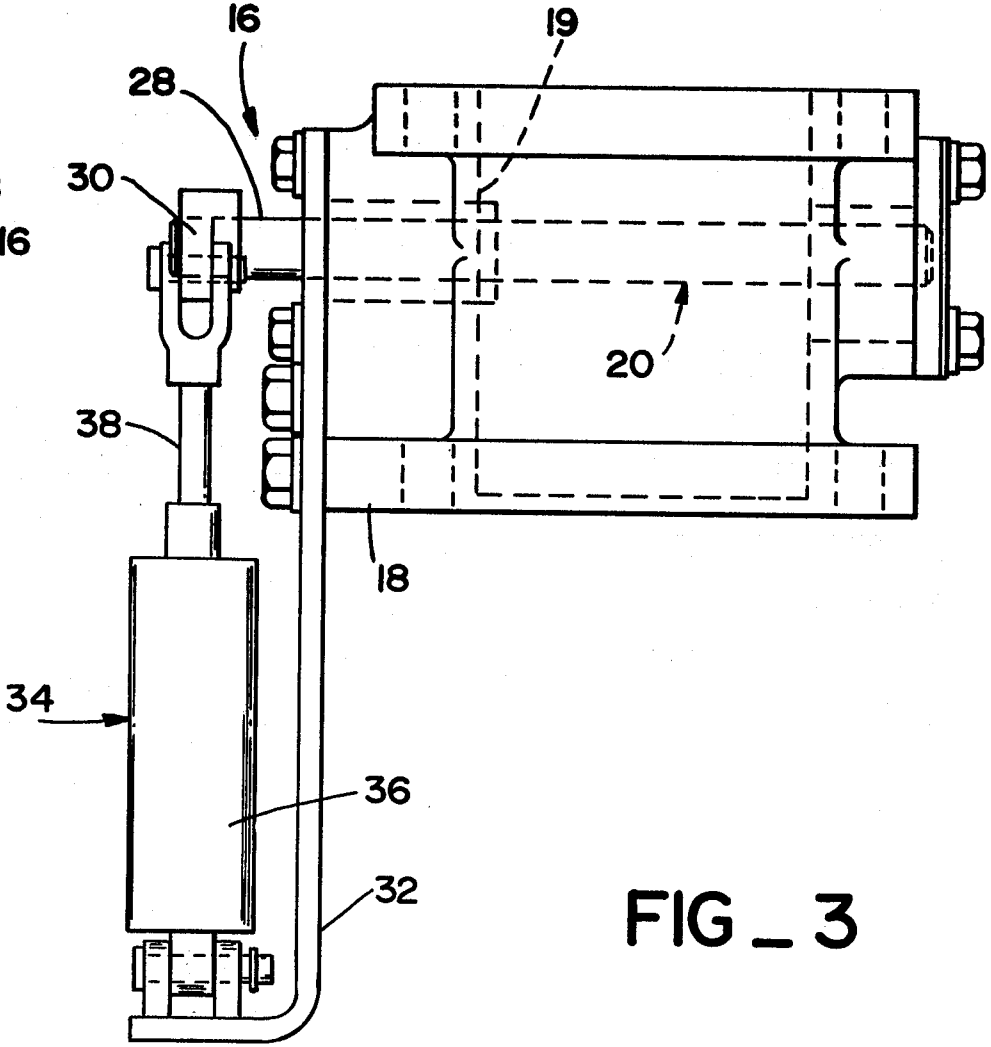
FIG. 3 is a front elevation of the apparatus.
Figure 2:
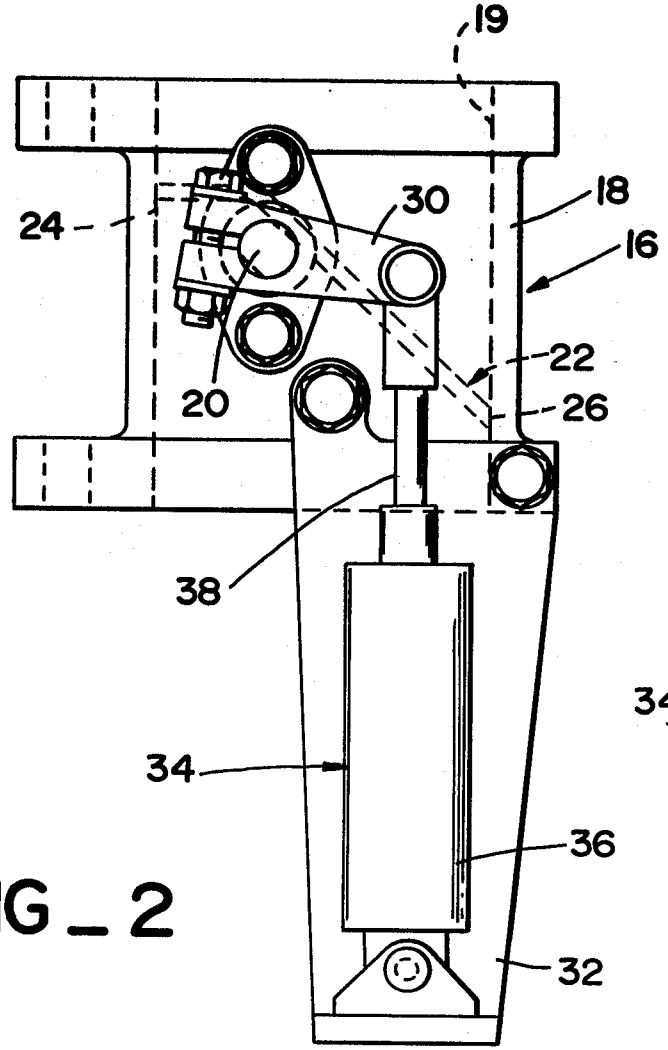
FIG. 2 is a side elevation of the apparatus.
Figure 4:
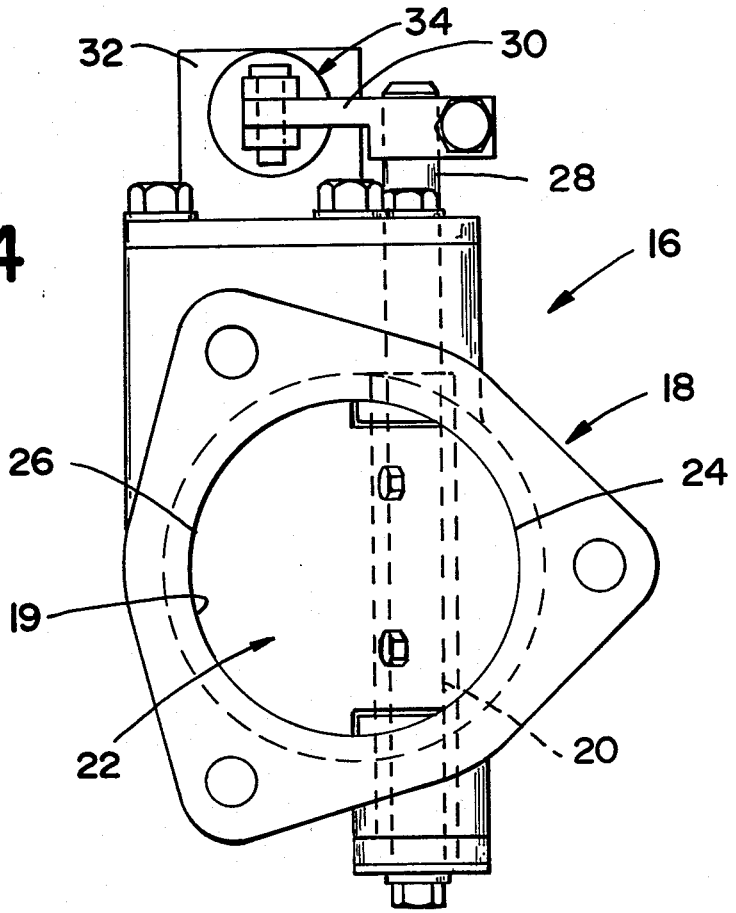
FIG. 4 is a top view of the apparatus.
Figure 5:
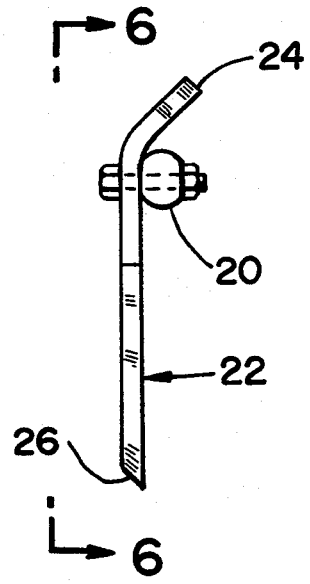
FIG. 5 is a view showing the overall configuration of the damper.
Figure 6:
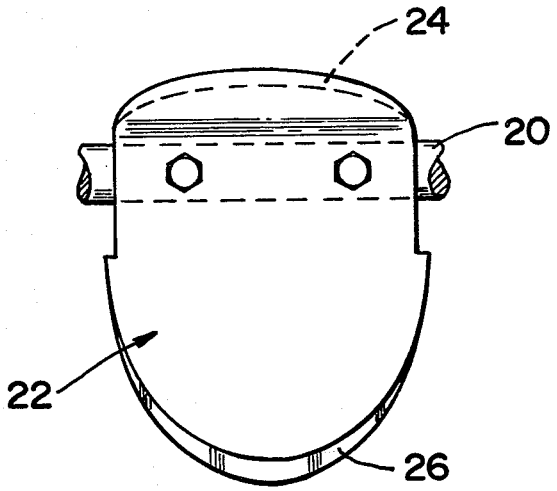
FIG. 6 is a view taken along the line VI—VI of FIG. 5.

Shown in FIG. 1 is a portion of a conventional internal combustion engine including an exhaust line 10, in turn including an exhaust manifold 12, an exhaust pipe 14, and the inventive apparatus 16 which bolts between the manifold 12 and pipe 14 to make up the overall exhaust line 10. The apparatus 16 is most clearly shown in FIGS. 2–6 and includes a main body 18 with a tubular inner bore 19 which actually makes up the portion interconnecting the manifold 12 and pipe 14. A shaft 20 is pivotally mounted to the main body 18 and extends through the tubular inner bore 19. The shaft 20 has bolted thereto a damper 22, defining edges 24, 26 which meet with the inner surface of the tubular bore 19 of the body 18 with the damper 22 in a closed position. The damper 22 is pivotable to an open position through pivoting of the shaft 20 relative to the body 18.

An end 28 of the shaft 20 extends outwardly of the main body 18. The extending end 28 of the shaft 20 has fixed thereto a lever arm 30, and a bracket 32 is secured to the main body 18 by bolts. An air cylinder 34 has its head end 36 pivotally connected to the bracket 32, and its rod end 38 pivotally connected to the extending end of the lever arm 30.

In the use of the apparatus, the air cylinder 34 is connected by means of a line 40 to a pressurized air chamber 42, through a solenoid-operated valve 44. The air chamber 42 may, with advantage, be the same air chamber for supplying pressurized air to the brakes of the vehicle. A switch 46, actuated by the vehicle accelerator linkage, is closable to actuate the solenoid-operated valve 44 to allow air pressure from the cylinder 42 to extend the rod 38 therefrom. Opening of the switch 46 allows release of air pressure from the cylinder 34.

The damper 22 is shaped and configured and positioned within the bore 19 of the main body 18 so that exhaust pressure exiting from the manifold 12 biases the damper 22 toward the open position thereof. It will be seen that application of air pressure to the cylinder 34 extends the rod 38 to pivot the lever 30 to in turn move the damper 22 to its closed position.

Pressure which might normally be applied to the air cylinder 34 may be in the order of 80–120 psi. The damper 22 is sized, configured and positioned, in relation to the pressure applied to the cylinder 34 and the overall configuration of the cylinder elements, to provide that the damper 22 will allow exhaust back pressure buildup to a certain level, but will release exhaust back pressure through the exhaust line 40 through opening movement of the damper 22. It has been found that in a particular apparatus, the choosing of the parameters set above to limit back pressure to approximately 30 psi is highly desirable. This has been found to avoid the problem of excessive back pressure buildup, which would result in the valve train failure discussed above.

THE EMBODIMENTS OF THE INVENTION IN WHICH AN EXCLUSIVE PROPERTY OR PRIVILEGE IS CLAIMED ARE DEFINED AS FOLLOWS:

1. Exhaust brake apparatus for an internal combustion engine including an exhaust line, wherein exhaust back pressure is to be limited to a certain level, comprising a damper movably mounted within said exhaust line, means operable by air pressure for moving said damper to its closed position, the damper having a first planar portion and a smaller second planar portion bent at an obtuse angle from said first planar portion in the direction of flow in the exhaust line, the damper further including a shaft portioned adjacent said second planar portion such that said shaft is offset from the centerline of the exhaust line, so that with a generally operable level of air pressure applied to the means operated by air pressure, the damper opens under a certain level of exhaust back pressure.

2. The apparatus of claim 1 wherein with said damper in the closed position, the first planar portion is provided at an angle to the exhaust line and said second planar portion is provided substantially perpendicular to the exhaust line.

3. The apparatus of claim 1 wherein the means operable by air pressure comprise air cylinder means.

4. The apparatus of claim 3 wherein the air cylinder means and damper are such that, with said generally operable level of air pressure applied to the air cylinder means, back pressure in the exhaust line is limited to approximately 30 psi.

* * * * *